US008979498B2

(12) United States Patent
Mazzola et al.

(10) Patent No.: US 8,979,498 B2
(45) Date of Patent: Mar. 17, 2015

(54) TURBINE AIRFOIL HAVING OUTBOARD AND INBOARD SECTIONS

(75) Inventors: Stefan Mazzola, Sanford, FL (US); John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 909 days.

(21) Appl. No.: 12/716,516

(22) Filed: Mar. 3, 2010

(65) Prior Publication Data

US 2011/0217178 A1 Sep. 8, 2011

(51) Int. Cl.
*F01D 5/14* (2006.01)

(52) U.S. Cl.
CPC ..... *F01D 5/14* (2013.01)
USPC ..... 416/223 A

(58) Field of Classification Search
USPC ..... 416/132 R, 213 R, 213 A, 204 A, 241 A
See application file for complete search history.

(56) References Cited

U.S. PATENT DOCUMENTS

| | | | | |
|---|---|---|---|---|
| 2,660,401 | A * | 11/1953 | Hull, Jr. | 416/243 |
| 4,540,339 | A * | 9/1985 | Horvath | 416/92 |
| 5,480,285 | A * | 1/1996 | Patel et al. | 416/223 A |
| 6,193,465 | B1 * | 2/2001 | Liotta et al. | 416/96 A |
| 7,334,993 | B2 * | 2/2008 | Sekihara et al. | 416/97 R |
| 7,762,783 | B2 * | 7/2010 | Cairo et al. | 416/223 R |
| 2005/0091848 | A1 * | 5/2005 | Nenov et al. | 29/889.1 |

FOREIGN PATENT DOCUMENTS

JP 58005402 A * 1/1983

* cited by examiner

*Primary Examiner* — Richard Edgar

(57) ABSTRACT

A turbine airfoil usable in a turbine engine and formed from at least an outboard section and an inboard section such that an inner end of the outboard section is attached to an outer end of the inboard section. The outboard section may be configured to provide a tip having adequate thickness and may extend radially inward from the tip with a generally constant cross-sectional area. The inboard section may be configured with a tapered cross-sectional area to support the outboard section.

13 Claims, 4 Drawing Sheets

TURBINE AIRFOIL HAVING OUTBOARD AND INBOARD SECTIONS

STATEMENT REGARDING FEDERALLY SPONSORED RESEARCH

Development of this invention was supported in part by the United States Department of Energy, Contract No. DE-FC26-05NT42644, H2 Advanced Hydrogen Turbine Development, Phase 2. Accordingly, the United States Government may have certain rights in this invention.

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine airfoils are formed from an elongated portion forming an airfoil having one end configured to be coupled to a disc and an opposite end configured to be a tip. As shown in FIG. 1, the airfoil is ordinarily composed of a leading edge, a trailing edge, a suction side, and a pressure side. The inner aspects of most turbine airfoils typically contain an intricate maze of cooling circuits forming a cooling system. The cooling circuits in the airfoils receive air from the compressor of the turbine engine and pass the air through the airfoil. At least some of the air passing through these cooling circuits is exhausted through orifices in the leading edge, trailing edge, suction side, and pressure side of the airfoil.

The turbine airfoil walls are load bearing in which the cumulative centrifugal loading of the airfoil is carried radially inward via the outermost wall. As such, the thickness required at the tip of the airfoil determines the thickness at the root. Typical turbine airfoils have increasing cross-sectional areas moving from the tip to the root, as shown in FIG. 2. The tip thickness is determined by casting tolerances that include allowances for variation in wall thickness plus the potential for internal cores to shift during the casting process. While simply designing an appropriate tip thickness and increasing the tip thickness to the root is feasible for small turbine airfoils, such is not the case for large airfoils useful in large turbine engines. In particular, when this design is scaled up to the larger engines, the root becomes larger than can be accommodated. In addition, the larger sized airfoil requires a part span snubber or tip shroud for vibration control, both of which become very difficult with the large size and temperature. Thus, an alternative configuration for a turbine airfoil is needed that is capable of being scaled up in size to without encountering the limitations of conventional cast airfoils.

SUMMARY OF THE INVENTION

This invention relates to a turbine airfoil formed from an inboard section and an outboard section attached thereto. The outboard section may be configured with a tip having an appropriate size. The remaining portions of the outboard section may be generally the same as the tip. The inboard section may be configured to support the outboard section. Forming the outboard section in this manner enables turbine airfoils to be formed in larger sizes than conventional configurations without creating centrifugal loading problems during turbine engine operation. The configuration of the outboard section enables the airfoil wall to be thinner than conventional airfoil walls and enables the airfoil wall of the outboard section to be generally constant along the length of the outboard section to the inboard section, which may begin at a point where the airfoil begins to carry the centrifugal load.

The turbine airfoil may be formed from a generally elongated hollow airfoil formed from an outer wall and may have a leading edge, a trailing edge, a pressure side, a suction side, a root at a first end of the airfoil and a tip at a second end opposite to the first end. The turbine airfoil may also include a cooling system positioned within interior aspects of the generally elongated hollow airfoil. The airfoil may be formed from an outboard section and an inboard section such that an inner end of the outboard section is attached to an outer end of the inboard section. The inner end of the outboard section and the outer end of the inboard section may have matching cross-sectional configurations. The inboard and outboard sections may be coupled together via one or more welds, mechanical connectors or through other appropriate ways. The outboard section may have a generally non-tapered cross-sectional area, and the inboard section may have a tapered cross-sectional area. The outboard section may have a length up to about 30 percent of a length of the outboard and inboard sections combined. The outboard and inboard sections may be formed at least in part by different materials. The outboard section may be formed at least partially from a material having a lesser density than a material used to form at least part of the inboard section.

An advantage of this invention is that by forming the airfoil from outboard and inboard sections, the sections may be individually cast, which allows the outboard and inboard sections to be thinner and thereby more efficient structurally than conventional airfoils.

Another advantage of this invention is that the outboard section may be formed from materials having a lower density than the inboard section, thereby increasing the structural efficiency of the airfoil by increasing the specific strength of the airfoil.

Yet another advantage of this invention is that the configuration of the outboard and inboard sections may reduce the centrifugal loads by more than 15 percent.

Another advantage of this invention is that the amount of stress in the outer walls forming the airfoils is reduced, thereby improving the overall structural efficiency of the airfoil.

Still another advantage of this invention is that the separately cast outboard section increases the structural efficiency in the critical outermost section of the airfoil and benefits the inboard section as it propagates radially inward through the airfoil.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
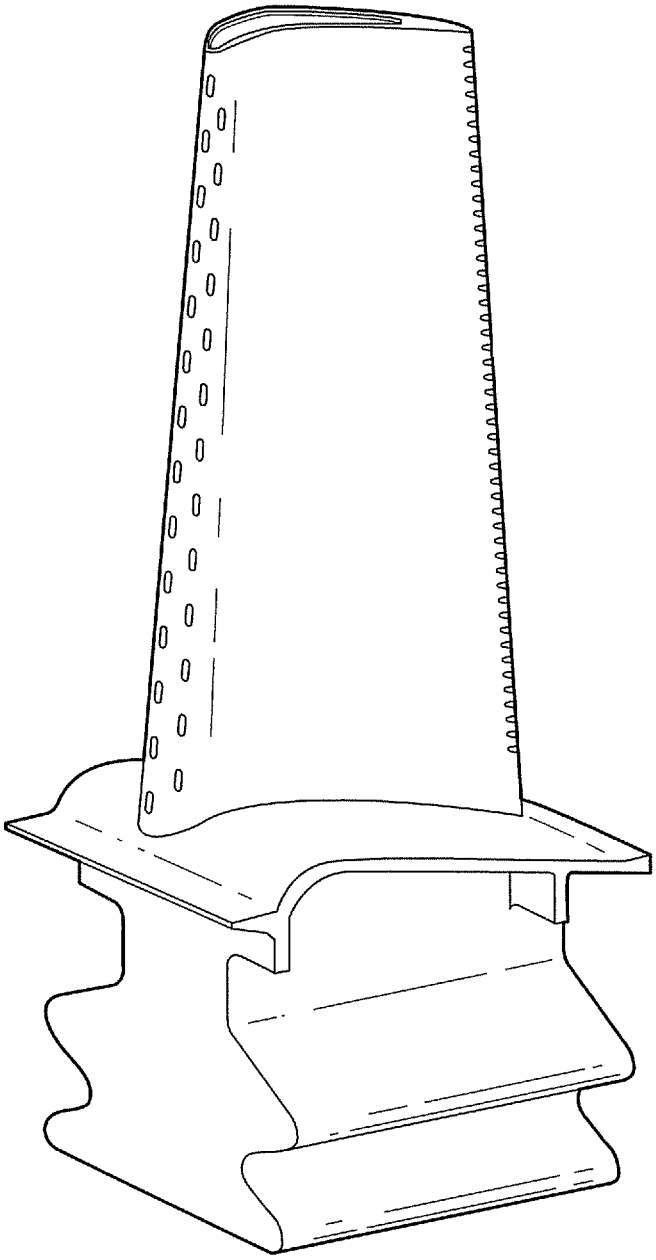
FIG. 1 (PRIOR ART)
FIG. 1 is a perspective view of a conventional turbine airfoil.
Figure 2:
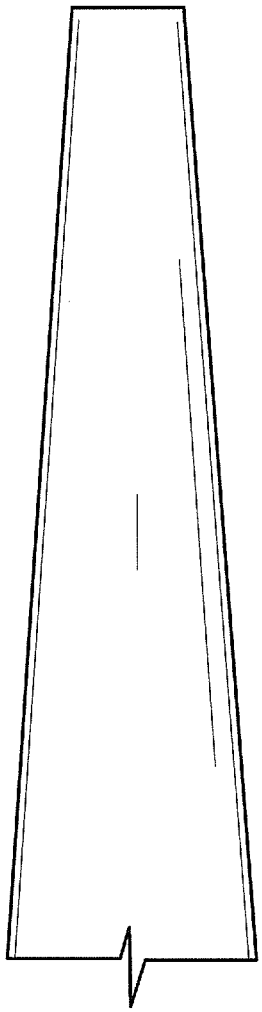
FIG. 2 (PRIOR ART)
FIG. 2 is a side view of the airfoil of FIG. 1.
Figure 3:
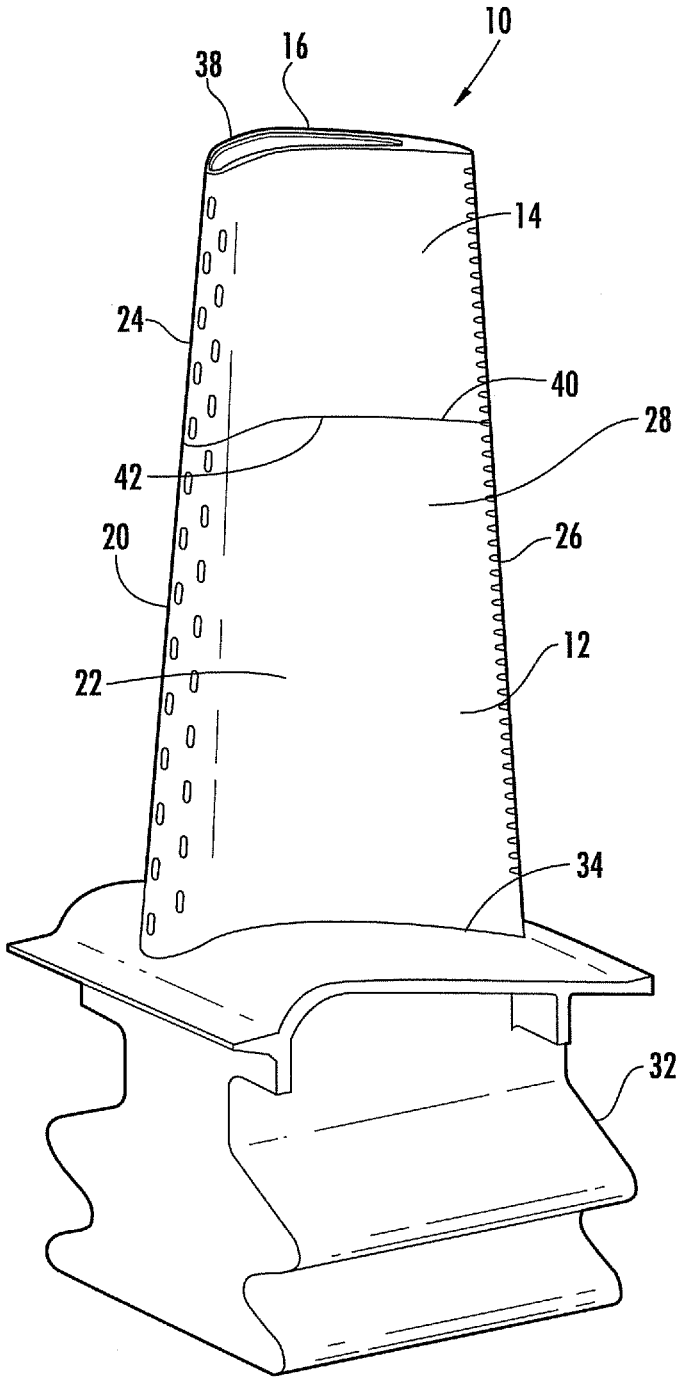
FIG. 3 is a perspective view of a conventional turbine airfoil having features according to the instant invention.
Figure 4:
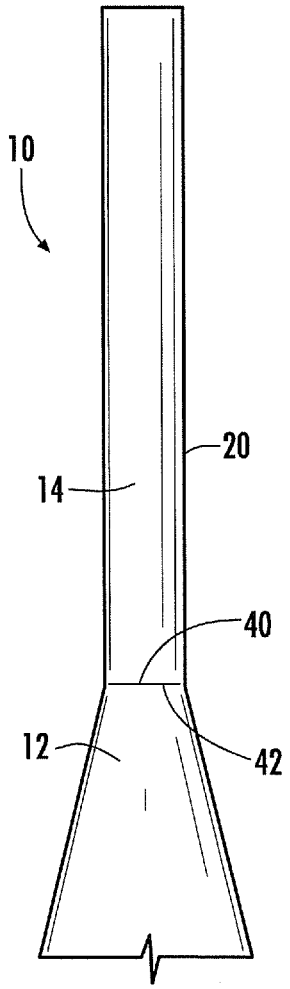
FIG. 4 is a side view of the airfoil of FIG. 3.

As shown in FIGS. 3-4, this invention is directed to a turbine airfoil 10 formed from an inboard section 12 and an outboard section 14 attached thereto. The outboard section 14 may be configured with a tip 16 having an appropriate size. The remaining portions of the outboard section 14 may be generally the same as the tip 16. The inboard section 12 may be configured to support the outboard section 14. Forming the outboard section 14 in this manner enables turbine airfoils 10 to be formed in larger sizes than conventional configurations without creating centrifugal loading problems during turbine engine operation. The configuration of the outboard section 14 enables the airfoil wall to be thinner than conventional airfoil walls and enables the airfoil wall of the outboard section 14 to be generally constant along the length of the outboard section 14 to the inboard section 12, which may begin at a point where the airfoil begins to require tapering walls to carry the increasing centrifugal load.

The turbine airfoil 10 may be a generally elongated hollow airfoil 20 formed from an outer wall 22. The generally elongated hollow airfoil 20 may have a leading edge 24, a trailing edge 26, a pressure side 28, a suction side 30, a root 32 at a first end 34 of the airfoil 20 and a tip 16 at a second end 38 opposite to the first end 34. The generally elongated hollow airfoil 20 may have any appropriate configuration and may be formed from any appropriate material. The turbine airfoil 10 may include a cooling system 10 positioned within interior aspects of the generally elongated hollow airfoil. The cooling system 10 may be positioned in the generally elongated hollow airfoil 20 and may have any appropriate cross-sectional shape.

The outboard section 14 may include an inner end 40 that is attached to an outer end 42 of the inboard section 12. The outboard section 14 may be attached via an appropriate manner. In at least one embodiment, the outboard section 14 may be attached to the inboard section 12 via one or more welds, or other appropriate metallurgical joining process. In other embodiments, the outboard section 14 may be attached to the inboard section 12 via one or more mechanical connectors, such as, but not limited to, one or more of the following, screw, bolt, rivot, cotter pin, and the like.

The outboard section 14 may have a generally non-tapered cross-sectional area, as shown in FIGS. 3 and 4. In particular, the outboard section 14 may be configured such that the tip 16 has an appropriate thickness because the as-cast wall thickness is more than sufficient to carry the cumulative centrifugal loading below stress limits. The thickness of the outboard section 14 may remain constant moving radially inward toward the root 32. The thickness of the outboard section 14 may remain generally constant until the airfoil 20 begins to require tapering to support centrifugal loads. The outboard section 14 may terminate generally at the location at which the airfoil 20 begins to taper to support centrifugal loads. In at least one embodiment, the outboard section 14 may have a length up to about 30 percent of a length of the outboard and inboard sections 14, 12 combined.

The inboard section 12 may have a tapered cross-sectional area that increases in size moving radially inward. In particular, the outer end 42 of the inboard section 12 and the inner end 40 of the outboard section 14 may have matching cross-sectional configurations such that the sections 12, 14 may be coupled together. The inboard and outboard sections 12 and 14 may be formed from different materials so that the airfoil 20 may be optimized. For example, the outboard section 14 may be formed at least partially from a material having a lesser density than a material used to form at least part of the inboard section 12. Because the outboard section 14 does not support as much centrifugal loads as does the inboard section 12, the outboard section 14 may be formed from materials that may have less strength than the one or more materials forming the inboard section 12, and thus may weigh less per unit area than the materials forming the inboard section 12. The different materials may have the same general chemistry but may differ in specific composition.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil, comprising:

a generally elongated airfoil formed from an outer wall, and having a leading edge, a trailing edge, a pressure side, a suction side, a root at a first end of the airfoil and a tip at a second end opposite to the first end;

wherein the airfoil is formed from an outboard section and an inboard section such that an inner end of the outboard section is attached to an outer end of the inboard section;

wherein the outboard section has a generally non-tapered, linear cross-sectional area extending from the pressure side to the suction side and includes the tip of the generally elongated hollow airfoil at an outer end of the outboard section, and the inboard section has a tapered cross-sectional area extending from the pressure side to the suction side and is coupled to the root; and wherein the outboard section may have a length up to about 30 percent of a length of the outboard and inboard sections combined and the outboard section has a sufficient length and is configured such that the configuration of the outboard and inboard sections may reduce the centrifugal loads by more than 15 percent.

2. The turbine airfoil of claim 1, wherein the outboard and inboard sections are formed at least in part by different materials having similar chemistry and differing in specific composition.

3. The turbine airfoil of claim 1, wherein the outboard section is formed at least partially from a material having a lesser density than a material used to form at least part of the inboard section.

4. The turbine airfoil of claim 1, wherein the outboard and inboard sections are welded together.

5. The turbine airfoil of claim 1, wherein the inner end of the outboard section and the outer end of the inboard section have matching cross-sectional configurations.

6. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

wherein the airfoil is formed from an outboard section and an inboard section such that an inner end of the outboard section is attached to an outer end of the inboard section;

wherein the outboard section has a generally non-tapered, linear cross-sectional area extending from the pressure side to the suction side and includes the tip of the generally elongated hollow airfoil at an outer end of the outboard section, and the inboard section has a tapered cross-sectional area extending from the pressure side to the suction side and is coupled to the root; and wherein the outboard section may have a length up to about 30 percent of a length of the outboard and inboard sections combined and the outboard section has a sufficient length and is configured such that the configuration of the outboard and inboard sections may reduce the centrifugal loads by more than 15 percent.

7. The turbine airfoil of claim 6, wherein the outboard and inboard sections are formed at least in part by different materials having similar chemistry and differing in specific composition.

8. The turbine airfoil of claim 6, wherein the outboard section is formed at least partially from a material having a lesser density than a material used to form at least part of the inboard section.

9. The turbine airfoil of claim 6, wherein the outboard and inboard sections are welded together.

10. The turbine airfoil of claim 6, wherein the inner end of the outboard section and the outer end of the inboard section have matching cross-sectional configurations.

11. A turbine airfoil, comprising:

a generally elongated hollow airfoil formed from an outer wall, and having a leading edge, a trailing edge, a pressure side, a suction side, a root at a first end of the airfoil and a tip at a second end opposite to the first end, and a cooling system positioned within interior aspects of the generally elongated hollow airfoil;

wherein the airfoil is formed from an outboard section and an inboard section such that an inner end of the outboard section is attached to an outer end of the inboard section;

wherein the outboard section has a generally non-tapered, linear cross-sectional area extending from the pressure side to the suction side and includes the tip of the generally elongated hollow airfoil at an outer end of the outboard section, and the inboard section has a tapered cross-sectional area extending from the pressure side to the suction side and is coupled to the root;

wherein the outboard and inboard sections are formed at least in part by different materials having similar chemistry and differing in specific composition;

wherein the inner end of the outboard section and the outer end of the inboard section have matching cross-sectional configurations; and wherein the outboard section may have a length up to about 30 percent of a length of the outboard and inboard sections combined and the outboard section has a sufficient length and is configured such that the configuration of the outboard and inboard sections may reduce the centrifugal loads by more than 15 percent.

12. The turbine airfoil of claim 11, wherein the outboard section is formed at least partially from a material having a lesser density than a material used to form at least part of the inboard section.

13. The turbine airfoil of claim 11, wherein the outboard and inboard sections are welded together.

* * * * *